United States Patent [19]

Held

[11] Patent Number: 4,589,948

[45] Date of Patent: May 20, 1986

[54] DOUBLE BAND PRESS OF MODULAR CONSTRUCTION

[76] Inventor: Kurt Held, Alte Str. 1, 7218 Trossingen 2, Fed. Rep. of Germany

[21] Appl. No.: 531,760

[22] Filed: Sep. 13, 1983

[30] Foreign Application Priority Data

Sep. 14, 1982 [DE] Fed. Rep. of Germany ..... 3234082

[51] Int. Cl.[4] ..... B30B 5/06; B30B 15/34

[52] U.S. Cl. ..... 156/555; 100/93 RP; 100/154; 156/583.5; 425/371

[58] Field of Search ..... 156/555, 582, 583.1, 156/583.5; 100/93 P, 93 RP, 151, 154; 425/371

[56] References Cited

U.S. PATENT DOCUMENTS

| | | | |
|---|---|---|---|
| 2,135,763 | 11/1938 | Nicholson | 100/35 |
| 3,381,609 | 5/1968 | Malarkey, Jr. | 100/154 |
| 3,587,451 | 6/1971 | Luthi | 100/154 |
| 3,671,365 | 6/1972 | Cover, Jr. et al. | 156/580 |
| 4,101,370 | 7/1978 | Russell | 100/154 |
| 4,265,608 | 5/1981 | Tunador et al. | 425/371 |
| 4,283,246 | 8/1981 | Held | 100/154 |
| 4,451,320 | 5/1984 | Marvel | 156/555 |

FOREIGN PATENT DOCUMENTS

| | | |
|---|---|---|
| 2059458 | 6/1972 | Fed. Rep. of Germany . |
| 2737629 | 3/1982 | Fed. Rep. of Germany . |

*Primary Examiner*—Michael Wityshyn

*Attorney, Agent, or Firm*—Toren, McGeady, Stanger, Goldberg & Kiel

[57] ABSTRACT

A double band press of modular construction for use in laminating operations is adaptable to different processing operations and conditions. The press includes two endless press bands each driven in an opposite direction around a pair of drums. A support structure carries the press bands and drums. On one side of the press, part of the support structure is arranged so that it can be at least partly disassembled for exchanging parts of the press and adjusting other parts so that the length, width and height of the press can be adapted to a particular operation and operating conditions.

8 Claims, 2 Drawing Figures

DOUBLE BAND PRESS OF MODULAR CONSTRUCTION

SUMMARY OF THE INVENTION

The present invention is directed to a double band press of modular construction for use in laminating operations and is adaptable to various processing operations and conditions. The press includes two endless press bands each driven around a pair of spaced drums. A support structure for the press bands and drums is constructed of a number of parts so that the press size can be adjusted as required.

It is very important in double band presses to be able to adapt the dimensions of the press without requiring complete reconstruction based on the particular operation being performed or the processing conditions. Depending on the operation to be performed, either an isobaric or an isochoric press is needed and each has different structural requirements.

Based on the current state of the art presses are presently available from Hymmen GmbH & Co. K.G., Kurt Held GmbH, the company of the applicant, and Contipress GmbH & Co. K.G. Further, other examples of the state of the art are found in German Patent No. 27 37 629, German Patent No. 936 718, German Patent No. 20 61 195, German Offenlegungsschrift No. 23 13 902, Austrian Patent 176 349, U.S. Pat. No. 3,521,552, German Offenlegungsschrift No. 21 40 105German Patent No. 22 65 401 and others indicate that the state of the art was not directed to press bands where the main elements were constructed and arranged so that only those elements needing adaption were replaced and all of the other elements remained unchanged.

Based on the known state of the art, a mechanical engineer must specify the static design of the support structure for the press for each of the machine dimensions, and for each design the support parts must be constructed and assembled. As an example, with increased machine length, the pressure plates bend more in the longitudinal direction. In German Patent No. 24 51 894 each press yoke has a separate gap adjustment by means of threaded spindles which lead to an expensive overdimensioning of the machine if it is only intended for low specific surface pressures.

In isochoric double band presses, the construction of the pressure plates must be different than is required for isobaric machines though the remaining main elements are unchanged under the same process conditions. There has been no suggestion in the prior art that the pressure plates could be quickly exchanged for isobaric or isochoric operation in the same press whereby increased use of the press is attained with a resultant improvement in the economy of operation.

Therefore, the primary object of the present invention is to arrange the main elements of a double band press, that is the carrier support, the pressure plates, the bearing supports, the threaded spindles for gap adjustment, the drying and return drums, and the press bands, and to arrange these elements relative to one another so that a press is provided which can be easily adapted to a given processing operation.

In accordance with the present invention, the support structure is capable of at least partial disassembly and other parts are arranged so that they can be replaced for varying the length, height or width of the press.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
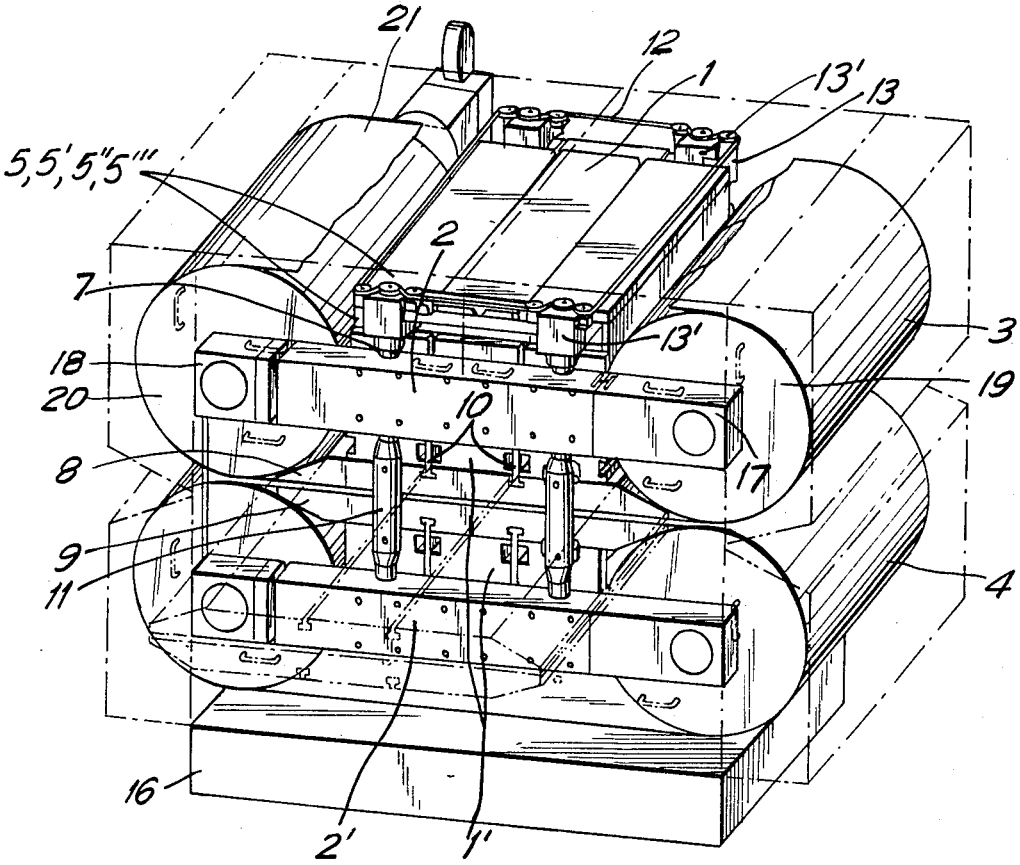
FIG. 1 is a schematic perspective illustration of a double band press embodying the present invention.

In the drawing a double band press is shown for effecting the laminating operation. Carrier supports 1 extend across the press and cover plates 1' are welded to the opposite ends of the supports. The cover plates 1' have saw-toothed sections, such as shown in U.S. Pat. No. 4,283,246, FIGS. 5*a* and 5*b* and provide a highly stressable, force-locking connection with the bearing or clamping supports 2.

Figure 2:
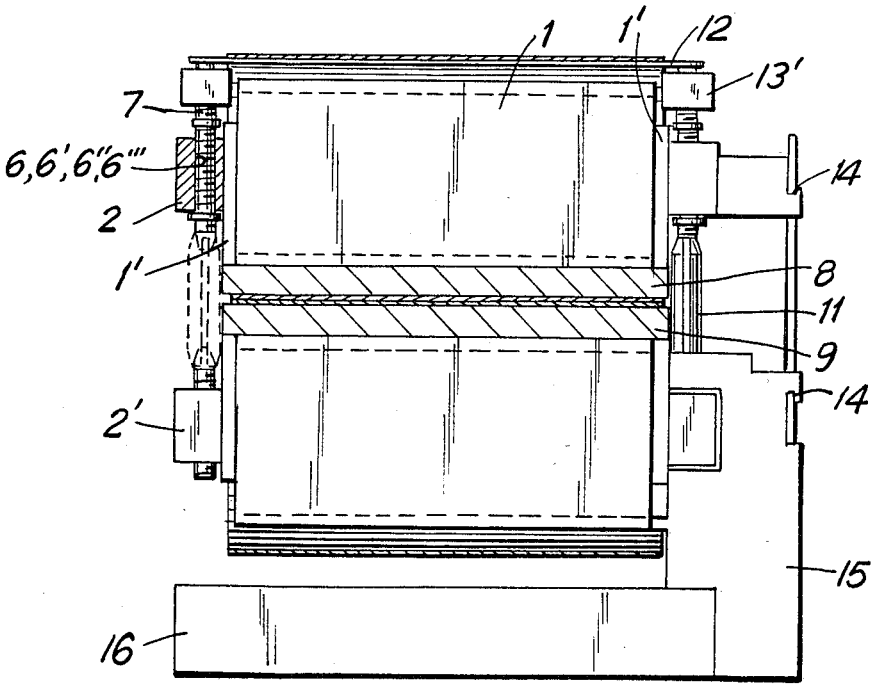
FIG. 2 is an elevational view, partly in section, of the double band press shown in FIG. 1.

The laminating operation is carried out between an upper double band unit 3 and a lower double band unit 4 each having an endless band driven around a pair of spaced drums 19, 20. Each band unit 3, 4 has a pair of bearing or clamping supports 2, 2' located on the opposite ends of the drums. The bearing supports are elongated in the travel direction of the endless bands between the drums. The bearing supports 2, 2 are joined or interconnected by adjustable threaded spindles 7 engaged in the threaded bores 6, 6', 6'', 6''' in the bearing supports, note FIG. 2. The bearing supports 2, 2' and the threaded spindles 7 provide a connection between the upper and lower band units 3, 4. The threaded spindles 7 in engagement with the upper bearing supports are connected to the threaded spindles 7 in engagement with the lower beariang supports by sleeve couplings 11. The sleeve couplings 11 interconnect aligned spindles 7 so they rotate as a unit.

In the space between the drums 19, 20 and positioned along the lower run of the upper double band unit 3 and the upper run of the lower double band unit 4 are pressure or heating plates 8, 9 attached to the carrier supports 1 by guide rails 10. By removing the sleeve couplings 11 from the threaded spindles 7, the plates 8, 9 can be moved on guide rollers, not shown, and pulled out of the upper or lower double band unit. If necessary, in accordance with a change in the operation of the double band press, the plates can be replaced.

To adjust the plane parallel press gap between the double band units 3, 4, the adjustable threaded spindles 7 are made up of two aligned parts one in each of the bearing supports 2, 2' and interconnected by the sleeve coupling 11 so that the parts and the coupling rotate as a unit. In such a unit, each threaded spindle part has an oppositely directed thread. When necessary, the sleeve coupling can be disassembled from the threaded spindle parts. The upper ends of the threaded spindle 7 are in engagement with a roller chain 12 by an adjustable drive 13 so that the movement of the bearing supports 2, 2' can be effected uniformly. By rotating the spindles 7 the dimension of the gap between the double band units can be varied as required.

An important feature in the adjustment of the press involves the quick disassembly of the sleeve couplings 11 and the ability to move the upper double band unit 3 against stops 14 at one side 15 of an L-shaped support structure or stand 16 so that the weight of the upper band unit is supported on the threaded spindles 7 when the sleeve couplings 11 are removed for adjusting the press band or for removing the plates 8, 9. In this condition, it is possible to replace the plates 8, 9 as mentioned above. The stand 16 has a vertically extending leg 15 and a horizontally arranged leg or base part.

At one end of the bearing supports 2, 2' fixed bearings 17 are provided and stress bearings 18 are located at the other ends. The dimensions of these bearings may be the same for the range of the double band press sizes, and the bearings can be dimensioned for the largest possible band press and when using press band unit sets as set forth in German Patent No. 27 35 142. The same is also true, with the exception of the length, for the drying drum 19 and the return drum 20. In place of a double band unit, a multi-band unit 21 can be used.

The advantage of the double band press constructed in accordance with the invention, are obvious. The carrier supports 1 have a basic configuration and with the addition of webs 5, 5', 5'', 5''', connected to the carrrier supports, the carrier supports can be used for a wide range of moments of resistance without change in their configuration for a cost effective structure. The cover plates 1' secured to the carrier supports 1 also said in the wide application of the carrier supports.

If a higher specific pressure or a greater press width is needed, then, in addition to higher moments of resistance, greater adjustable spindle cross sections are needed. To satisfy the required change, the same size spindles 7 can be used with a larger number of spindles being employed at closer distances in the bearing supports and such arrangement does not change the remaining parts of the press.

For longer pressure zones, the length of the bearing supports 2, the length of the plates 8, 9 and the band unit length can be changed, while the remaining parts stay the same, or if necessary are used in a different number. The adjustable drive 13 for the spindles 7 and the associated reduction gears 13' which are overdimensioned at the outset without any significant expenditure, act on all of the required adjustable spindles 7 by a roller chain 12 of increased length and, if necessary, of larger cross-section.

If a press is to be equipped for isochoric operation in accordance with German Patent No. 27 35 142, or for combined isochoric-isobaric operation according to German patent application No. P 31 35 031.3-14, then the effect of the different required pressure on the necessary moment of resistance of the press band and the higher band tensions, resulting from the higher pressure, is obtained by a corresponding number of pressed band layers in the band units in the press. With this arrangement, it is possible to keep unchanged the diameter of the drying drum 19 and the return drum 20 as well as the other dimensions, depending thereon, of the other basic elements of the press.

A press embodying the present invention permits the manufacturer to construct certain basic elements in larger series without any definite orders so that the elements can be delivered without delay. A person using such a press may, during its useful life, convert to a different pressing operation, or expand its capacity and the like, merely by replacing the main elements manufactured by the supplier when a change is required.

While specific embodiments of the invention have been shown and described in detail to illustrate the application of the inventive principles, it will be understood that the invention may be embodied otherwise without departing from such principles.

I claim:

1. A double band press of modular construction for use in laminating operations and adaptable to various processing operations and conditions, comprising an L-shaped stand comprising a horizontal base part and a vertical part extending upwardly from said base part, two pair of spaced drums with one pair located above the other, said drums being horizontally arranged with one end of each said drum being supported on said vertical part of said stand with the other end extending outwardly from the vertical part, two endless press band each extending around a different one of said pairs of drums so that said bands are disposed in opposed relation one above the other, said bands arranged to run in opposite directions, means in combination with said press bands and drums for effecting the laminating operation on materials passed between said press bands, and means arranged in cooperation with said stand for supporting said drums, said press bands and said means for effecting lamination, wherein the improvement comprises that said supporting means being capable of at least partial disassembly and said means for effecting lamination being replaceable for varying at least one of the length, height and width of the press, at least part of said supporting means being capable of at least partial disassembly at the ends of said drums spaced outwardly from said vertical part of said stand so that certain of said means for effecting lamination can be replaced, said supporting means comprises carrier supports located between said drums of each said pair of drums, upper and lower bearing supports elongated in the direction of movement of said press bands between said drums with said upper bearing supports supporting the upper ones of said drums and said lower bearing supports supporting the lower ones of said drums, said upper and lower bearing supports having vertically extending threaded bores extending therethrough transversely of the elongated direction thereof so that said bores in said upper supports are in alignment with said bores in said lower bearing supports, upper and lower adjustment upwardly extending threaded spindles with said upper threaded spindles in threaded engagement with said bores in said upper bearing supports and said lower threaded spindles in threaded engagement with said bores in said lower bearing supports, a sleeve coupling arranged to be disassembled is disposed in threaded engagement with a pair of aligned said upper and lower threaded spindles for connecting the pair of said upper and lower threaded spindles each of which extends through a different said bearing support so that the interconnected said upper and lower threaded spindles rotate together and can adjust the space between said bearing supports, a pair of heating plates each associated with a different one of said press bands and extending along the portion of said press band adjacent the other said press band and between said drums over which said press band runs, means for displaceably supporting said heating plates, means for rotating each pair of interconnected said threaded spindles at the same time, a fixed bearing located in one end of each of said bearing supports and a stress bearing located in the other end of each of said bearing supports, whereby said sleeve coupling can be disassembled from said threaded spindles after said double band units are moved apart away from one another by operating said means for rotating said threaded spindles for replacing at least one of the press bands and the heating plates.

2. A double band press, as set forth in claim 1, wherein said carrier supports include cover plates secured to the opposite ends thereof, said cover plates including sawtooth sections disposed in force-locking connection to said bearing supports.

3. A double band press, as set forth in claim 1, wherein said carrier supports include guide rails extending therefrom toward the adjacent said heating plate, said heating plates are attached to said guide rails so that after the removal of said sleeve couplings said heating plates can be removed and replaced by movement relative to said carrier supports.

4. A double band press, as set forth in claim 1, wherein said means for rotating said threaded spindles comprises an adjustable drive, a roller chain driven by said adjustable drive and in driving engagement with said upper threaded spindles so that by driving said upper threaded spindles and the interconnected said sleeve couplings and lower threaded spindles, said bearing supports along with said drums and said press bands can be moved one of toward and away from another for adjusting the press gap between adjacent runs of said press bands.

5. A double band press, as set forth in claim 1, wherein for one of higher pressure operation or operation with increased press width, the cross-section of said adjustable upper or lower spindles can be increased.

6. A double band press, as set forth in claim 1, wherein for operation at one of higher pressures and increased press width, the number of pairs of said adjustable upper and lower spindles is increased and the spacing between the pair of said adjustable upper and lower spindles in said bearing supports is decreased.

7. A double band press, as set forth in claim 1, wherein said supporting means comprises stops located on said vertical part of said L-shaped stand, and by rotating said threaded spindles, the upper one of said press bands can be moved against said stops so that said L-shaped stand supports the upper said press band.

8. A double band press, as set forth in claim 1, wherein webs are secured to said carrier supports for affording a range of bending moments of said carrier support.

* * * * *